United States Patent [19]

Kawagishi et al.

[11] 4,111,767

[45] Sep. 5, 1978

[54] ELECTROLYTIC STRIPPING BATH FOR REMOVING METAL COATINGS FROM STAINLESS STEEL BASE MATERIALS

[75] Inventors: Shigemitsu Kawagishi, Kadoma; Yasunori Arisato, Daito, both of Japan

[73] Assignee: Okuno Chemical Industry Co., Ltd., Osaka, Japan

[21] Appl. No.: 860,454

[22] Filed: Dec. 14, 1977

[30] Foreign Application Priority Data

Dec. 7, 1977 [JP] Japan ..... 52-147673

[51] Int. Cl.[2] ..... C25F 5/00

[52] U.S. Cl. ..... 204/146

[58] Field of Search ..... 204/146, 129.75; 252/79.4

[56] References Cited

U.S. PATENT DOCUMENTS

| | | | |
|---|---|---|---|
| 3,619,390 | 11/1971 | Dillenberg | 204/146 |
| 3,649,489 | 3/1972 | Dillenberg | 204/146 |
| 3,649,491 | 3/1972 | Bowers et al. | 204/146 |
| 3,788,958 | 1/1974 | Dillenberg | 204/146 |

*Primary Examiner*—G. L. Kaplan

*Attorney, Agent, or Firm*—David T. Nikaido; James E. Armstrong; Charles M. Marmelstein

[57] ABSTRACT

Electrolytic stripping bath for removing metal coatings from stainless steel base material comprising at least one reducing compound selected from the group consisting of dimethylformamide, formaldehyde, thiosulfates, sulfites, hydrazine, hydroxylamine and dimethylaminoboron with the conventional compounds and having a pH of 6.0 to 9.5.

4 Claims, No Drawings

ELECTROLYTIC STRIPPING BATH FOR REMOVING METAL COATINGS FROM STAINLESS STEEL BASE MATERIALS

This invention relates to electrolytic stripping baths for removing metal coatings from stainless steel base materials.

In forming electrophoretic metal coatings on articles of stainless steel such as tools and gears, the metal coating, when found defective, must be removed to form a fresh metal coating again. In the electrophoretic coating of workpieces, a rack is usually used for securing the workpiece in position. For this purpose, a rack of stainless steel is generally used which may be partially coated with polyvinyl chloride, polyethylene or the like when so desired. The coating operation gives a deposition also on the rack. The accumulation of such a deposition is undesirable, rendering the rack no longer satisfactorily serviceable in securing the workpiece. The deposition must therefore be removed.

Various methods of removal have heretofore been proposed. According to the proposed methods, coated articles can be stripped by: (1) immersing the article in concentrated nitric acid; (2) chemically dissolving the coating with use of a nitro compound and at least one of ethylenediamine and sodium cyanate; and (3) electrolytically dissolving the coating. The first method gives off large quantities of gas or mist, producing seriously deleterious effects on the environment, and has another drawback of causing damage to the synthetic resin coating on the rack. The method in which a nitro compound and at least one of ethylenediamine and sodium cyanate are used is commercially disadvantageous in that it requires a prolonged period of time and that the ethylenediamine should be used in a large quantity. Because of these disadvantages, the electrolytic dissolving method has found wide use in recent years.

A wide variety of electrolytic baths are already known for use in this method. Examples are a bath consisting predominantly of a sulfate or sulfonate (U.S. Pat. No. 3,649,489 and No. 3,788,958), a bath consisting predominantly of sodium hydroxide or a pyrophosphate (British Pat. No. 1,278,954) and a bath consisting essentially of a nitrate (U.S. Pat. No. 3,619,390 and No. 3,649,491). Of these baths, the bath consisting essentially of a nitrate is extremely convenient and is therefore most widely used because it is capable of dissolving any metal that is usable for electrophoretic coating such as copper, nickel, chromium, tin, lead, solder, zinc, cadmium or the like.

The bath nevertheless has the drawback that if it is attempted to speed up the removal of the coating (as achieved by increasing the anodic current density or by the addition of halogen ions or specifically of chlorine ions to the bath), the bath dissolves also the base material of stainless steel, whereas an attempt to prevent the dissolving of the stainless steel base material invariably leads to a reduced rate of removal.

The main object of this invention is to provide stripping baths of the type described containing a nitrate and capable of rapidly removing electrophoretic coatings from stainless steel base materials almost without dissolving the base materials.

The object of this invention can be achieved by adding about 1 to about 100 g/l of at least one reducing compound selected from the group consisting of dimethylformamide, formaldehyde, thiosulfates, sulfites, hydrazine, hydroxylamine and dimethylaminoboron to a stripping composition consisting of a nitrate, a chlorine ion donor, and an amine compound and/or an organic acid having a buffering action, and adjusting the resulting bath to a pH of 6.0 to 9.5.

Stated more specifically, this invention provides an electrolytic stripping bath for removing metal coatings from stainless steel base materials comprising about 50 to about 500 g/l of a water-soluble nitrate, about 1 to about 200 g/l of a chlorine ion donor, about 0.5 to about 200 g/l of at least one of amine compounds and organic acids having a buffering action, and about 1 to about 100 g/l of at least one reducing compound selected from the group consisting of dimethylformamide, formaldehyde, thiosulfates, sulfites, hydrazine, hydroxylamine and dimethylaminoboron, the stripping bath having a pH of 6.0 to 9.5.

Our research has revealed that when a stripping bath containing a nitrate, a chlorine ion donor and a buffer further incorporates the reducing compound, the bath rapidly dissolves and removes electrophoretic depositions from stainless steel base materials almost without dissolving the base materials. This will be apparent from Examples and Comparison Examples.

Examples of water-soluble nitrates useful in this invention are those heretofore used for stripping baths of the type described, such as ammonium nitrate, potassium nitrate and sodium nitrate, among which ammonium nitrate is preferable. The water-soluble nitrate is used usually in an amount of about 50 to about 500 g/l, preferably about 100 to about 350 g/l.

The chlorine ion donor used in this invention serves as a removal accelerator. Examples of useful donors are those releasing chlorine ions in the stripping bath, such as hydrochloric acid, sodium chloride, potassium chloride, calcium chloride, ammonium chloride and nickel chloride. Also useful are substances which release chlorine ions in the stripping bath in the course of electrolysis, such as ethyl chloride, ethylene chlorohydrin, allyl chloride and chloral hydrate. Of these examples, sodium chloride, ammonium chloride, chloral hydrate and ethylene chlorohydrin are preferable to use. The chlorine ion donor is used in an amount of about 1 to about 200 g/l, preferably about 5 to about 100 g/l.

Examples of amine compounds and organic acids having a buffering action are ammonia, ethylenediamine, diaminopropane, diethylenetriamine, triethylenetetramine, tetraethylenepentamine, monoethanolamine, diethanolamine, triethanolamine, cyclohexylamine, aniline, toluidine, dimethylaniline, sulfanilic acid, urea, glycine, aspartic acid, alanine, glutamic acid, aminobenzoic acid, aminosuccinic acid, iminodiacetic acid, nitrilotriacetic acid, quadrol, ethylenediaminetetraacetic acid and like amine compounds, and acetic acid, succinic acid, itaconic acid, maleic acid, fumaric acid, phthalic acid, citric acid, malic acid, gluconic acid, glycolic acid, lactic acid, tartaric acid, mannitol and like organic acids. Among them ammonia, ethylenediamine, mono-, di- and tri- ethanolamine, glycine, glutamic acid, nitrilotriacetic acid, ethylenediaminetetraacetic acid, succinic acid, tartaric acid and citric acid are preferable. These compounds exhibit a buffering action, maintaining the pH of the bath at a predetermined value and also produces a complexing effect on metals, immediately complexing the metal ions liberated from the anode, thereby assisting in the subsequent removal of the deposited metal. The buffering substance is used in an amount of about 0.5 to about 200 g/l, preferably about 5 to about 100 g/l.

Examples of useful reducing compounds are dimethylformamide, formaldehyde, thiosulfates, sulfites, hydrazine, hydroxylamine and dimethylaminoboron. These compounds are used alone or in combination. Examples of thiosulfates are thiosulfates of alkali metals such as sodium thiosulfate and potassium thiosulfate. Useful sulfites include sulfites of alkali metals representative of which are for example sodium sulfite and potassium sulfite. Hydroxylamine includes hydroxylamine salts of inorganic acid such as sulfuric acid or hydrochloric acid. The reducing compound is used in an amount of about 1 to about 100 g/l, preferably about 5 to about 50 g/l. The reducing compound, when used in an amount of more than about 100 g/l, tends to impair the stripping ability of the nitrate, whereas with less than about 1 g/l of the reducing compound present, the stainless steel base material becomes more likely to dissolve. Preferable reducing compounds are hydrazine, dimethylformamide and hydroxylamine.

It is critical that the stripping bath of this invention have a pH of 6.0 to 9.5, preferably 6.5 to 8.5. If the pH value is lower than 6.0, the stainless steel base material has a greater tendency to dissolve, whereas at pH values of higher than 9.5, a reduced anodic current efficiency will result, leading to a lower rate of removal. The pH is adjustable by the addition of nitric acid or acetic acid, or of sodium hydroxide or ammonia.

Electrophoretically coated base materials of stainless steel can be stripped with use of the stripping bath of this invention by subjecting the stainless steel base material to electrolysis as the anode using a carbon, titanium steel or stainless steel cathode at a current density of about 5 to about 150 A/dm$^2$, preferably about 10 to about 100 A/dm$^2$, at a bath temperature of about 10° to about 80° C., preferably about 20° to about 50° C. Typical examples of stainless steels for which the stripping bath of this invention is usable are iron-chromium alloys, iron-nickel-chromium alloys, etc. The coatings which are removable by the stripping bath of this invention are those of almost any metals which are usually used for electrophoretic coating operation, such as nickel, chromium, tin, lead, solder, zinc, cadmium, etc.

Electrophoretic coatings are rapidly removable from stainless steel base materials by the use of the stripping bath of this invention without substantially dissolving the base materials but with greatly improved efficiency. Moreover the stripping operation can be carried out at a current density of about 10 to about 100 A/dm$^2$. The narrow pH range of 6.0 to 9.5 employed for the operation minimizes pH variations, rendering the bath easy to maintain, and affords another advantage that nearly 100% anodic current efficiency is achievable free of any power loss.

The present invention will be described below in greater detail with reference to Examples.

EXAMPLE 1

| | |
|---|---|
| Ammonium nitrate | 200 g |
| Sodium chloride | 20 g |
| Glacial acetic acid | 20 g |
| Ethylenediamine | 30 g |
| Dimethylformamide | 30 g |

The above compounds are formulated into 1l of an aqueous solution with addition of water, and the solution is adjusted to a pH of 7.0. A stainless steel panel (AISI standard #304) electrophoretically coated with three layers, i.e. a 30-$\mu$ thick copper coating, a 20-$\mu$ thick nickel coating and a 0.5-$\mu$ thick chromium coating, is immersed in the solution and subjected to electrolysis as the anode at 40 A/dm$^2$ and 30° C. for 30 minutes with use of a stainless steel cathode. The copper, nickel and chromium coatings are completely removed from the stainless steel panel with very slight corrosion taking place in the panel as indicated in Table 1 below.

EXAMPLE 2

| | |
|---|---|
| Sodium nitrate | 250 g |
| Ammonium chloride | 25 g |
| Citric acid | 50 g |
| Monoethanolamine | 50 g |
| Hydrazine | 30 g |

With addition of water, the compounds given above are formulated into 1l of an aqueous solution, which is then adjusted to a pH of 7.5. Electrolysis is carried out in the same manner as in Example 1 except that this solution is used under the conditions of 30° C. of and 50 A/dm$^2$. The results are given in Table 1.

EXAMPLE 3

| | |
|---|---|
| Potassium nitrate | 200 g |
| Hydrochloric acid (concn. 33%) | 45 g |
| Glycine | 40 g |
| Tartaric acid | 60 g |
| Hydroxylamine sulfate | 15 g |
| Formaldehyde | 10 g |

With addition of water, the above compounds are formulated into 1l of an aqueous solution, which is then adjusted to a pH of 6.5. Electrolysis is carried out in the same manner as in Example 1 except that this solution is used under the conditions of 25° C. and 40 A/dm$^2$. Table 1 shows the results.

EXAMPLE 4

| | |
|---|---|
| Ammonium nitrate | 300 g |
| Ethylene chlorohydrin | 50 g |
| Succinic acid | 15 g |
| Ethylenediaminetetraacetic acid | 20 g |
| Sodium sulfite | 40 g |

With addition of water, the above compounds are formulated into 1l of an aqueous solution, which is then adjusted to a pH of 7.0. Electrolysis is carried out in the same manner as in Example 1 except that this solution is used under the conditions of 35° C. and 60 A/dm$^2$. Table 1 shows the results.

COMPARISON EXAMPLE 1

Electrolysis is conducted exactly in the same manner as in Example 1 except that dimethylformamide is not used.

COMPARISON EXAMPLE 2

Electrolysis is conducted in the same manner as in Example 2 except that hydrazine is not used.

COMPARISON EXAMPLE 3

Electrolysis is conducted in the same manner as in Example 3 except that hydroxylamine sulfate and formaldehyde are not used.

COMPARISON EXAMPLE 4

Electrolysis is conducted in the same manner as in Example 4 except that sodium sulfite is not used.

COMPARISON EXAMPLE 5

Electrolysis is conducted in the same manner as in Example 1 except that 30 g of sodium hypophosphite is used in place of dimethylformamide.

COMPARISON EXAMPLE 6

Electrolysis is conducted in the same manner as in Example 1 except that 20 g of sodium borohydride is used in place of dimethylformamide.

Table 1

| Stripping bath | Removal rate (μ/min) | Corrosion in stainless steel ($mg/cm^2.hr$) |
|---|---|---|
| Example 1 | 7.1 | 6.8 |
| 2 | 6.4 | 3.4 |
| 3 | 7.9 | 4.6 |
| 4 | 5.9 | 9.8 |
| Comp. Ex. 1 | 7.3 | 116.3 |
| 2 | 6.5 | 102.7 |
| 3 | 8.0 | 188.0 |
| 4 | 6.1 | 95.6 |
| 5 | 7.1 | 79.5 |
| 6 | 7.0 | 116.9 |

Table 1 reveals that the the use of stripping baths of this invention achieves high removal rates with greatly reduced corrosion of the stainless steel base material, whereas the baths of Comparison Examples containing no reducing substance, although comparable to the baths of the invention in removal rate, produce marked corrosion of the stainless steel. It is especially noteworthy that Comparison Examples 5 and 6, despite the use of reducing compounds, fail to achieve such outstanding effects as attained by the use of the specific compounds of the present invention.

What is claimed is:

1. An electrolytic stripping bath for removing metal coatings from stainless steel base materials comprising about 50 to about 500 g/l of a water-soluble nitrate, about 1 to about 200 g/l of a chlorine ion donor about 0.5 to about 200 g/l of at least one of amine compounds and organic acids having a buffering action, and about 1 to about 100 g/l of at least one reducing compound selected from the group consisting of dimethylformamide, formaldehyde, thiosulfates, sulfites, hydrazine, hydroxylamine and dimethylaminoboron, the stripping bath having a pH of 6.0 to 9.5.

2. The electrolytic stripping bath for removing metal coatings from stainless steel base materials according to claim 1 which comprises about 100 to about 350 g/l of a water-soluble nitrate, about 5 to about 100 g/l of a chlorine ion donor, about 5 to about 100 g/l of at least one of amine compounds and organic acids having a buffering action, and about 5 to about 50 g/l of at least one reducing compound selected from the group consisting of dimethylformamide, formaldehyde, thiosulfates, sulfites, hydrazine, hydroxylamine and dimethylaminoboron.

3. The electrolytic stripping bath for removing metal coatings from stainless steel base materials according to claim 1 in which the pH is in the range of 6.5 to 8.5.

4. The electrolytic stripping bath for removing metal coatings from stainless steel base materials according to claim 1 in which the reducing compound is at least one species selected from the group consisting of hydrazine, dimethylformamide and hydroxylamine.

* * * * *